United States Patent [19]

Palmer

[11] Patent Number: 4,653,741

[45] Date of Patent: Mar. 31, 1987

[54] VACUUM FLOW SENSOR

[75] Inventor: Robert W. Palmer, Scandia, Minn.

[73] Assignee: Brantjen & Kluge, Inc., St. Croix Falls, Wis.

[21] Appl. No.: 827,533

[22] Filed: Feb. 10, 1986

[51] Int. Cl.[4] ..... B65H 3/08

[52] U.S. Cl. ..... 271/90; 271/103; 271/108; 271/265

[58] Field of Search ..... 271/90, 107, 108, 103, 271/110, 111, 265

[56] References Cited

U.S. PATENT DOCUMENTS 4,451,197 5/1984 Lange ..... 271/103 X

FOREIGN PATENT DOCUMENTS 556091 5/1977 U.S.S.R. ..... 271/108

*Primary Examiner*—Richard A. Schacher

*Attorney, Agent, or Firm*—Peterson, Wicks, Nemer & Kamrath

[57] ABSTRACT

A vacuum flow sensor is described according to the preferred teachings of the present invention for providing an electrical signal to the controls of a printing press or the like indicating that a sheet of paper has been picked up by the finger members and is blocking the flow of air through the finger members to the vacuum source through the vacuum passageway. Specifically, the sensor includes an actuator movable within an actuator passageway towards a first, seated position under the force of gravity and away from the first position under the force of air flowing through the vaccum passageway and against the force of gravity. A proximity switch is provided for sensing when the actuator is in its first position. The actuator passageway is angular in shape and includes a shock absorber in the end of the actuator passageway opposite to the first position for tending to prevent the actuator from bouncing in the actuator passageway due to abrupt changes in air flow through the vacuum passageway. In its preferred form, the actuator is generally cylindrical in shape and includes a reduced diameter portion defining a passage for air flow when the actuator is located in its first, seated position to provide an operating threshold for the vacuum flow sensor.

20 Claims, 3 Drawing Figures

VACUUM FLOW SENSOR

BACKGROUND

The present invention relates generally to apparatus for detecting whether a sheet of paper has been picked up by the finger members of a printing press or the like and particularly to vacuum flow sensors.

In a printing press or the like, it is desired to move a sheet of paper from one position to another such as from an unprinted stock of paper to the printing press or from the printing press to a printed stock location. This is typically accomplished by utilizing finger members connected to a vacuum source through a vacuum passageway and which pick up sheets of paper by vacuum. To allow mechanized operation of the printing press, it is necessary to detect whether or not the finger members have picked up a sheet of paper and to provide suitable input to the printing press controls. Initially this was accomplished by pure mechanical controls which included structure which deflected according to the amount of vacuum present in the line and by mechanical linkage from the structure controling the press operation. This was later replaced by devices having membranes which measured the amount of vacuum present in the line and closed a switch providing an electrical signal to the press controls. However, such prior vacuum measuring devices were disadvantageous for several reasons. Specifically, such devices had a finite life, were subject to dust accumulation, and were subject to the generation of false signals due to change in the paper stock, changes in the vacuum source, and the like.

Thus, a need has arisen for providing accurate and sensitive input to the press controls of whether or not a sheet of paper has been picked up by the finger members.

SUMMARY

The present invention solves these and other needs and other problems in the printing press and vacuum detection fields by providing a vacuum flow sensor which senses whether or not air is flowing through the vacuum passageway rather than sensing the degree of vacuum present in the vacuum passageway. The vacuum flow sensor includes an actuator movable within an actuator passageway towards a first position when a sheet of paper has been picked up by the finger members and is blocking the finger members and blocking the flow of air through the finger members to the vacuum source through the vacuum passageway allowing the actuator to fall to its first position under the force of gravity and movable away from the first position under the force of air flowing through the finger members to the vacuum source through the vacuum passageway and against the force of gravity when a sheet of paper is not blocking the finger members. In a preferred form of the present invention, the vacuum flow sensor further includes a member for sensing whether or not the actuator is in its first position and for providing an electrical signal to the controls indicating whether or not a sheet of paper has been picked up by the finger members.

In another aspect of the present invention, the vacuum flow sensor allows air to flow through the actuator at a rate less than through the vacuum passageway when a sheet of paper is not blocking the finger members for providing an operating threshold before the actuator moves away from its first position due to air flow through the vacuum passageway.

In still another aspect of the present invention, the actuator passageway has first and second portions interconnected together at an angle in the range of 155° for tending to prevent the actuator from bouncing in the actuator passageway due to abrupt changes in the air flow in the vacuum passageway. Specifically, the angular configuration of the actuator passageway allows the actuator to ricochet off the second face of the first portion of the actuator passageway moving to its first position under the force of gravity and with the second face of the second portion of the actuator passageway restraining the actuator in the first portion of the actuator passageway in the event of the abrupt stopping of air flow through the vacuum passageway from the finger members to the vacuum source and which could cause the actuator to rebound out of its first position.

It is thus an object of the present invention to provide a novel device for sensing flow in a vacuum passageway.

It is further an object of the present invention to provide such a novel vacuum flow sensor tending to prevent the generation of false signals due to abrupt changes in flow through the vacuum passageway.

It is further an object of the present invention to provide such a novel vacuum flow sensor having an operating threshold.

It is further an object of the present invention to provide such a novel vacuum flow sensor allowing air flow through the actuator to provide an operating threshold.

It is further an object of the present invention to provide such a novel vacuum flow sensor which is not subject to fatigue.

It is further an object of the present invention to provide such a novel vacuum flow sensor having an extended life span.

It is further an object of the present invention to provide such a novel vacuum flow sensor which does not accumulate paper dust and the like.

It is further an object of the present invention to provide such a novel vacuum flow sensor which is self-clearing.

It is further an object of the present invention to provide such a novel vacuum flow sensor allowing visual inspection.

It is further an object of the present invention to provide such a novel vacuum flow sensor which provides an electrical signal to the controls indicating whether or not an actuator is in its seated position.

It is further an object of the present invention to provide such a novel vacuum flow sensor which has a single moving part which is generally not subject to wear.

It is further an object of the present invention to provide such a novel vacuum flow sensor having a simple design which is inexpensive to manufacture and assemble.

It is further an object of the present invention to provide such a novel vacuum flow sensor having a uniquely-shaped actuator.

It is further an object of the present invention to provide such a novel vacuum flow sensor which tends to prevent the actuator from bouncing in the actuator passageway due to abrupt changes in the flow through the vacuum passageway.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
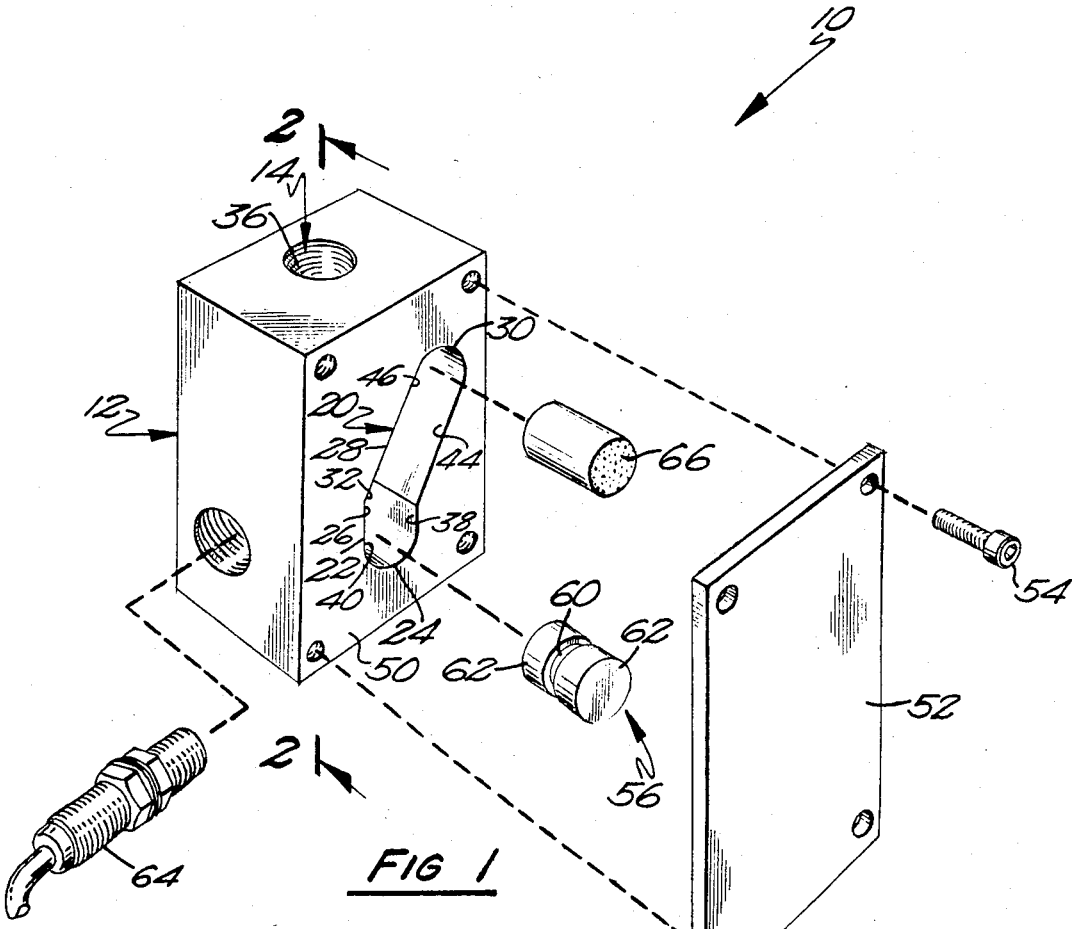
FIG. 1 shows an exploded, perspective view of a preferred embodiment of a vacuum flow sensor constructed according to the teachings of the present invention.
Figure 2:
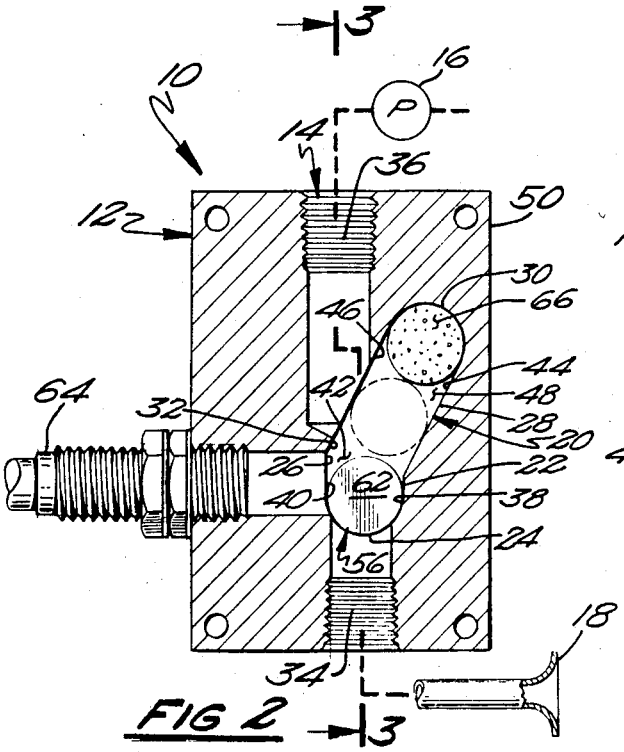
FIG. 2 shows a sectional view of the vacuum flow sensor of FIG. 1 in an assembled condition and according to section line 2—2 of FIG. 1.
Figure 3:
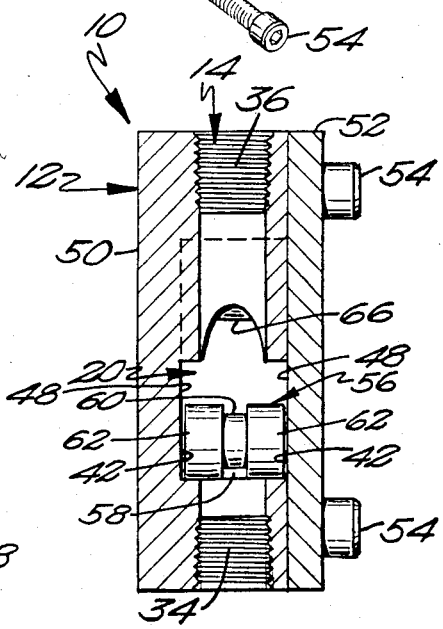
FIG. 3 shows a sectional view of the vacuum flow sensor of FIG. 1 according to section line 3—3 of FIG. 2.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", and similar terms are used herein, it should be understood that these terms have reference only to the structure shown in the drawings as it would appear to a person viewing the drawings and are utilized only to facilitate describing the invention.

DESCRIPTION

A vacuum flow sensor according to the preferred embodiment of the teachings of the present invention is shown in the drawings and generally designated 10. Sensor 10 generally includes a body 12 having a passageway 14 through which air may flow to a source of vacuum 16 such as a pump to finger members 18 for picking up paper to be fed to a printing press or the like.

Sensor 10 further includes an actuator passageway 20 which intersects with passageway 14. Specifically, passageway 20 includes a first portion 22 having a first end 24 and a second, open end 26 and a second portion 28 including a first end 30 and a second, open end 32. In its most preferred form, portions 22 and 28 intersect and are joined together by their second ends 26 and 32 to form passageway 20. Passageway 20 then divides passageway 14 into a first portion 34 and a second portion 36.

In its most preferred form, portion 22 of passageway 20 comprises a hollow parallelepiped including two parallel faces 38 and 40 and two parallel sides 42. Portion 34 of passageway 14 terminates in end 24 of portion 22 generally parallel to faces 38 and 40. In its most preferred form, end 24 is concave in shape. In its most preferred form, the cross sectional dimensions and specifically in the preferred form of the present invention the diameter of portion 34 is slightly smaller than the spacing between faces 38 and 40 and the spacing between sides 42.

In its most preferred form, portion 28 of passageway 20 comprises a hollow parallelepiped including two parallel faces 44 and 46 and two parallel sides 48. Portion 36 of passageway 14 terminates in face 46 of portion 28 adjacent to end 32. In its most preferred form, end 30 is concave in shape. In its most preferred form, the cross section dimensions and specifically in the preferred form of the present invention the diameter of portion 36 is slightly smaller than the spacing between faces 44 and 46 and the spacing between sides 48. In its most preferred form, portions 34 and 36 of passageway 14 are of identical cross sectional sizes.

It can then be appreciated that faces 38 and 44, faces 40 and 46, and sides 42 and 48 of portions 22 and 28 of passageway 20 intersect and are contiguous with each other to form a cavity. In its most preferred form, portions 22 and 28 of passageway 20 are at an angular relationship and specifically are at an angle in the range of 155° such that faces 38 and 44 and faces 40 and 46 intersect and are at angle of 155°. In its most preferred form, portions 22 and 28 are of identical cross sectional sizes. In its most preferred form, portions 34 and 36 of passageway 14 are offset from each other such that the center of portion 34 is located along the center of portion 22 of passageway 20 and the center of portion 36 is spaced slightly from the center of portion 22 in a direction opposite from face 38.

In its most preferred form, body 12 is formed of two members 50 and 52. Member 50 is in the form of a parallelepiped and member 52 is in the form of a plate secured to member 50 by suitable members 54 such as screws. Passageway 20 is then formed by a cavity formed in member 50 and with one of sides 42 and 48 being formed by member 52. Portions 34 and 36 of passageway 14 are formed by bores spaced from the surfaces of member 50 and intersecting with the cavity forming passageway 20. In its most preferred form, at least member 52 is translucent to allow visual inspection of the interior of passageway 20.

Vacuum flow sensor 10 according to the teachings of the present invention includes an actuator 56 for movement in passageway 20 under the presence of air flow through passageway 20. In its preferred form, actuator 56 has a size and shape complementary to and for seating in end 24 of passageway 20 and for generally obstructing portion 34 of passageway 14. In its most preferred form, actuator 56 is generally cylindrical in shape.

In the preferred form, actuator 56 includes a passage 58 which overlies portion 34 when actuator 56 is seated in end 24 of passageway 20 for allowing air flow through actuator 56 at a rate less than through passageway 14 with actuator 56 not in a seated position in end 24. In its preferred form, passage 58 is formed by a reduced diameter portion 60 intermediate end portions 62 giving actuator 56 a barbell shape. Specifically, in its most preferred form, portion 60 has a cylindrical shape having a diameter less than the diameter of cylindrical shaped portions 62. It can then be realized that the size of passage 58 and thus the rate of air flow through passage 58 may then be varied by the particular size, i.e. diameter and length of portion 60, chosen.

Vacuum flow sensor 10 according to the teachings of the present invention includes a member 66 located in portion 28 adjacent to end 30 for damping any bouncing of actuator 56. In its most preferred form, member 66 is cylindrical in shape having a diameter substantially equal to the diameter of end 30 and is formed of closed cell urethane foam. Member 66 can be secured in position by any suitable method such as by adhesive.

It can then be appreciated that if paper does not cover finger members 18, air flows through finger members 18, portion 34, passageway 20, and portion 36 to vacuum source 16, with the air flow removing actuator 56 from end 24 of passageway 20 and forcing it against gravity into portion 28 of passageway 20 beyond portion 36 of passageway 14. When finger members 18 engage with a sheet of paper, the paper blocks the entry of air into finger members 18 such that air flow through finger members 18 and passageways 14 and 20 to vacuum source 16 is substantially eliminated. Without air flow, gravity causes actuator 56 to fall in passageway 20 seating in end 24 thereof. It can then be appreciated that when actuator 56 is seated in end 24 of passageway 20, an obstruction such as a sheet of paper is blocking finger members 18 and that when actuator 56 is not seated in end 24 of passageway 20, finger members 18 are not obstructed such as by a sheet of paper.

Vacuum flow sensor 10 according to the teachings of the present invention further includes a member 64 for sensing that actuator 56 is seated in end 24 of passageway 20 and for providing an electrical signal to the controls of the printing press or other apparatus. In its preferred form, sensing member 64 is a proximity switch positioned adjacent to face 40 of portion 22 of passageway 20 which is able to detect when actuator 56 is located adjacent to face 40, i.e. when seated in end 24 of passageway 20, and close an electric circuit. In its most preferred form, actuator 56 is formed of ferrous material, body 12 is formed of non-ferrous material, and sensing member 64 closes an electric circuit when ferrous material is detected. In its most preferred form, sensing member 64 is a model TL-X proximity switch (DC switching type) manufactured by Omron Tateisi Eletronics Co. Thus, when a sheet of paper is blocking finger member 18 such that there is no air flow through passageway 20, actuator 56 is seated in end 24 by gravity where it is detected by sensing member 64 and thus placing it in a first switch position which then provides an electrical signal to the press controls signifying that a sheet of paper has been picked up by finger members 18. On the other hand, when a sheet of paper is not blocking finger members 18 such that there is air flow through passageways 14 and 20, actuator 56 is forced into portion 28 of passageway 20 beyond portion 36 where it is not detected by sensing member 64 and thus placing it in a second switch position which then provides an electrical signal to the press controls signifying that a sheet of paper has not been picked up by finger members 18.

It should then be realized that vacuum flow sensor 10 according to the teachings of the present invention includes provisions for tending to prevent false signals as the result of rapid variation in the vacuum condition. For example, when the vacuum is first started to finger members 18 from vacuum source 16, the abrupt start of air flow could force actuator 56 to unseat from end 24 of passageway 20 with sufficient force such that it would rebound from end 30 of passageway 20 in front of sensing member 64 to generate a false signal that actuator 56 was seated in end 24. Member 66 is provided secured to end 30 of passageway 20 according to the preferred form of the present invention to act as a shock absorber in absorbing the force which could cause actuator 56 to rebound into the operating zone of sensing member 64 to thus substantially prevent sensing member 64 from generating a false signal. Likewise, when finger members 18 engage with a sheet of paper, the air flow from finger members 18 to vacuum source 16 may be abruptly stopped. The abrupt stopping of air flow could force actuator 56 to seat in end 24 of passageway 20 with sufficient force such that it would rebound from end 24 of passageway 20 out of the operating zone of sensing member 64 to generate a false signal that actuator 56 was not seated in end 24. The angular configuration of passageway 20 generally prevents actuator 56 from leaving the operating zone of sensing member 64 since actuator 56 is generally maintained in portion 22 of passageway 20 and does not enter portion 28 of passageway 20. Specifically, when actuator 56 falls under gravity from portion 28 in the absence of air flow, it ricochets off face 40 of portion 22 into seat 24 of passageway 20, with the deflection reducing the force with which actuator 56 seats in end 24 of passageway 20. Further, if actuator 56 should bounce from end 24, the angular relationship of portions 22 and 28 causes actuator 56 to hit face 46 of passageway 20 and generally be restrained in portion 22 of passageway 20. Thus, the unique features of vacuum flow sensor 10 according to the teachings of the present invention substantially prevent false signals to the press control by sensing member 64 arising from actuator 56 bouncing in passageway 20.

Now that the construction and general operation of vacuum flow sensor 10 according to the teachings of the present invention has been set forth, the subtle features and advantages of the present invention can be set forth and appreciated. Prior to the present invention, detection of whether finger members 18 of a printing press or the like had picked up a sheet of paper and providing a electric signal to its control was done by measuring the amount of vacuum present in the passageways between members 18 and vacuum source 16. It can then be appreciated that vacuum flow sensor 10 according to the teachings of the present invention also detects whether a sheet of paper has been engaged by finger members 18 and provides an electrical signal to the press controls but accomplishes this function by a different method, i.e. it senses air flow through the vacuum passageway rather than attempting to measure the degree of vacuum present in the vacuum passageway.

It should then be noted that prior vacuum measuring devices had a finite life because of their mechanical constructions including membranes and springs which were subject to fatigue. Vacuum flow sensor 10 according to the teachings of the present invention has only one moving part, i.e. actuator 56, which is not subject to fatigue and specifically does not include springs, membranes, and the like which are especially prone to fatigue and wear and have a finite life as in prior vacuum measuring devices. In fact, the life span of vacuum flow sensor 10 according to the teachings of the present invention depends basically solely on the life span of the solid state proximity switch member 64, which is considerably longer than prior mechanical type vacuum measuring devices.

It can then be appreciated that due to the nature of vacuums, paper dust and other objects are sucked into finger members 18 and flow through the passageways towards vacuum source 16. Since prior vacuum measuring devices were located on dead end passageways and specifically did not include flow through, such paper dust and the like would accumulate in the vacuum measuring devices resulting in inaccurate measuring and/or inoperativeness. Vacuum flow sensor 10 according to the teachings of the present invention does not accumulate such paper dust and is self-clearing. Specifically, since air flows through passageways 14 and 20, paper dust tends to be carried with the air flow through sensor 10 to vacuum source 16 and does not accumulate as where air flow is not provided as in prior vacuum measuring devices. Further, movement of actuator 56 in passageway 20 tends to dislodge any foreign material or particles which should lodge in passageway 20 such that the foreign material is sucked into the air flow towards vacuum source 16. Furthermore, due to the transparency of plate 52, visual inspection of passageway 20 and actuator 56 is possible to insure that vacuum flow sensor 10 is operating according to the teachings of the present invention and that no foreign material is lodged in sensor 10.

It should then additionally be appreciated that the cylindrical shape of actuator 56 of the most preferred form of the present invention is particularly advantageous. Specifically, the length of cylindrical shape allows actuator 56 to maintain an axial orientation in passageway 20. The circular cross section of the cylindrical shape of portion 60 and 62 of actuator 56 allows a symmetry around its axis such that actuator 56 may rotate about its axis without effecting its ability to seat in end 24 of passageway 20. Further, the area exposed to sensing member 64 is greater with the cylindrical shape of actuator 56 according to the teachings of the present invention than other shapes such as spherical. Therefore, the accuracy and sensitivity of vacuum flow sensor 10 according to the teachings of the present invention is increased while reducing false readings generated from vacuum flow variations.

It should then also be appreciated that the thickness of paper being picked up by finger members 18 plays an important role in the vacuum operation. Specifically, it should be noted that a greater vacuum is required for heavier stock paper than lighter stock paper. Likewise, vacuum source 16 pulls air through the paper at a greater rate for lighter stock than through heavier stock, with heavier stock possibly even preventing air being sucked therethrough. It is then necessary to adjust vacuum source 16 to accommodate the stock of paper to be printed upon. With prior vacuum measuring devices, it was also necessary to adjust such devices if the adjustment of vacuum source 16 was outside of its limited operating zone. Since vacuum flow sensor 10 according to the teachings of the present invention does not attempt to measure the vacuum but rather senses air flow caused by the vacuum, vacuum flow sensor 10 has a larger operating zone and is less dependent on variations in paper stock and/or vacuum source 16.

Further, air flow through the paper stock often resulted in false signals generated by prior vacuum measuring devices. Passage 58 in actuator 56 of vacuum flow sensor 10 according to the teachings of the present invention provides an operating threshold to prevent such false signal generation. Specifically, passage 58 in actuator 56 allows the limited air flow sucked through the paper stock to pass therethrough without unseating actuator 56 from end 24 of passageway 20 whereas greater air flow such as when paper is not blocking finger members 18 is not able to pass through passage 58 and raises actuator 56 from end 24. Thus, the operating threshold of vacuum flow sensor 10 according to the teachings of the present invention is preset according to the size of passage 58 in actuator 56 and may be varied by replacing actuator 56 having passage 58 of the desired size. Further, the operating zone of vacuum flow sensor 10 according to the teachings of the present invention is much broader than prior vacuum measuring devices since it is not prone to the level of vacuum which may be highly variable for different paper stocks having various degrees of air through flow. Thus, vacuum flow sensor 10 according to the teachings of the present invention is additionally advantageous for this separate, independent reason over prior vacuum measuring devices.

Now that the basic teachings of the present invention have been explained, many extensions and variations will be obvious to one having ordinary skill in the art. For example, although vacuum flow sensor 10 has been described in its most preferred form including several unique aspects and features which have been utilized in a single construction believed to be particularly advantageous, other constructions may be obvious to persons skilled in the art after the teachings become known which do not utilize all of the aspects and features of the present invention in a single unit.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. In a printing press or the like where a sheet of paper is moved from one position to another by picking the sheet of paper up by vacuum finger members connected to a vacuum source through a vacuum passageway, with the printing press including suitable controls for operating the printing press, with the improvement comprising a vacuum flow sensor located in the vacuum passageway between the vacuum finger members and the vacuum source comprising, in combination: a body member having an actuator passageway, with the actuator passageway intersecting with and dividing the vacuum passageway into a first portion and a second portion; an actuator movable within the actuator passageway towards a first position when a sheet of paper has been picked up by the finger members and is blocking the finger members and blocking the flow of air through the finger members to the vacuum source through the vacuum passageway allowing the actuator to fall to its first position under the force of gravity and movable away from the first position under the force of air flowing through the finger members to the vacuum source through the vacuum passageway and against the force of gravity when a sheet of paper is not blocking the finger members; and means for sensing that the actuator is in its first position and for providing an electrical signal to the controls indicating that a sheet of paper has been picked up by the finger members.

2. The vacuum flow sensor of claim 1 wherein the sensing means is a proximity switch which detects when ferrous material is adjacent thereto, with the proximity switch being mounted in the body adjacent to the first position of the actuator in the actuator passageway; and wherein the actuator is formed of ferrous material and wherein the body member is formed of nonferrous material.

3. The vacuum flow sensor of claim 2 wherein the actuator is cylindrical in shape and includes a side and ends, wherein the proximity switch is mounted in the body adjacent to the side of the cylindrical shaped actuator in its first position for increasing the area exposed to the sensing member for increasing the accuracy and sensitivity of the vacuum flow sensor.

4. The vacuum flow sensor of claim 3 further comprising, in combination: means for providing an operating threshold before the actuator moves away from its first position due to air flow through the vacuum passageway, wherein the operating threshold means tend to prevent generating false electrical signals to the controls when air flow is pulled through the sheet of paper blocking the finger members to the vacuum source through the vacuum passageway.

5. The vacuum flow sensor of claim 4 wherein the operating threshold means comprises, in combination: means for allowing air flow through the actuator at a rate less than through the vacuum passageway when a sheet of paper is not blocking the finger members.

6. The vacuum flow sensor of claim 5 wherein the air flow allowing means comprises, in combination: a reduced diameter, cylindrical-shaped portion intermediate the ends of the cylindrical-shaped actuator giving the actuator a barbell shape and defining a passage for air flow through the vacuum passageway when the actuator is located in its first position.

7. The vacuum flow sensor of claim 1 further comprising, in combination: means for tending to prevent the actuator from bouncing in the actuator passageway due to abrupt changes in the air flow through the vacuum passageway from the finger members to the vacuum source.

8. The vacuum flow sensor of claim 7 wherein the actuator passageway includes a first end and a second end, wherein the actuator seats in the first end of actuator passageway in the first position; and wherein the bouncing preventing means comprises, in combination: a shock absorber located at the second end of the actuator passageway for absorbing the force from the actuator resulting from the actuator moving from its first position due to the abrupt start of air flow through the vacuum passageway from the finger members to the vacuum source and which could cause the actuator to rebound into its first position.

9. The vacuum flow sensor of claim 7 wherein the actuator passageway includes a first portion and a second portion, with the first portion of the actuator passageway comprising a hollow parallelepiped including a first closed end, a second open end, a first closed face, a second closed face, a first closed side, and a second closed side, with the second portion of the actuator passageway comprising a hollow parallelepiped including a first closed end, a second open end, a first closed face, a second closed face, a first closed side, and a second closed side, with the second ends of the first and second portions of the actuator passageway being connected and with the first faces of the first and second portions intersecting at an angle in the range of 155° and with the second faces of the first and second portions intersecting at an angle in the range of 155°, with the actuator seating in the first end of the first portion of the actuator passageway in the first position, with the actuator ricocheting off the second face of the first portion of the actuator passageway moving to its first position under the force of gravity and with the second face of the second portion of the actuator passageway restraining the actuator in the first portion of the actuator passageway in the event of the abrupt stopping of air flow through the vacuum passageway from the finger members to the vacuum source and which could cause the actuator to rebound out of its first position.

10. The vacuum flow sensor of claim 9 wherein the first portion of the vacuum passageway terminates in the first end of the first portion of the actuator passageway, with the first portions of the vacuum passageway and actuator passageway being axially aligned; wherein the second portion of the vacuum passageway terminates in the second face of the second portion of the actuator passageway adjacent to its second end, with the second portion of the vacuum passageway being parallel to the first portions of the vacuum passageway and the actuator passageway.

11. The vacuum flow sensor of claim 1 wherein the body member comprises, in combination: a parallelepiped-shaped member and a plate member secured thereto, with the actuator passageway being formed by a cavity formed in the parallelepiped-shaped member and closed by the plate member, with the first and second portions of the vacuum passageway being formed by bores formed in the parallelepiped-shaped member and intersecting with the cavity.

12. The vacuum flow sensor of claim 11 wherein the plate member is translucent to allow visual inspection of the actuator passageway and of the movement of the actuator within the actuator passageway.

13. The vacuum flow sensor of claim 1 further comprising, in combination: means for providing an operating threshold before the actuator moves away from its first position due to air flow through the vacuum passageway, wherein the operating threshold means tends to prevent generating false electrical signals to the controls when air flow is pulled through the sheet of paper blocking the finger members to the vacuum source through the vacuum passageway.

14. The vacuum flow sensor of claim 13 wherein the operating threshold means comprises, in combination: means for allowing air flow through the actuator at a rate less than through the vacuum passageway when a sheet of paper is not blocking the finger members.

15. The vacuum flow sensor of claim 14 wherein the actuator is cylindrical in shape and includes a side and ends; and wherein the air flow allowing means comprises, in combination: a reduced diameter, cylindrical-shaped portion intermediate the ends of the cylindrical-shaped actuator giving the actuator a barbell shape and defining a passage for air flow through the vacuum passageway when the actuator is located in its first position.

16. In a printing press or the like where a sheet of paper is moved from one position to another by picking the sheet of paper up by vacuum finger members connected to a vacuum source through a vacuum passageway, with the printing press including suitable controls for operating the printing press, with the improvement comprising a vacuum flow sensor located in the vacuum passageway between the vacuum finger members and the vacuum source comprising, in combination: a body member having an actuator passageway, with the actuator passageway intersecting with and dividing the vacuum passageway into a first portion and a second portion; an actuator movable within the actuator passageway towards a first position when a sheet of paper has been picked up by the finger members and is blocking the finger members and blocking the flow of air through the finger members to the vacuum source through the vacuum passageway allowing the actuator to fall to its first position under the force of gravity and movable away from the first position under the force of air flowing through the finger members to the vacuum source through the vacuum passageway and against the force of gravity when a sheet of paper is not blocking the finger members; and means for allowing air flow through the actuator at a rate less than through the vacuum passageway when a sheet of paper is not blocking the finger members for providing an operating threshold before the actuator moves away from its first position due to air flow through the vacuum passageway, wherein the operating threshold means tending to prevent generating false signals when air flow is pulled through the sheet of paper blocking the finger members to the vacuum source through the vacuum passageway.

17. The vacuum flow sensor of claim 16 wherein the actuator is cylindrical in shape and includes a side and ends; and wherein the air flow allowing means comprises, in combination: a reduced diameter cylindrical-shaped portion intermediate the ends of the cylindrical-shaped actuator giving the actuator a barbell shape and defining a passage for air flow through the vacuum passageway when the actuator is located in its first position.

18. The vacuum flow sensor of claim 16 further comprising, in combination: means for tending to prevent the actuator from bouncing in the actuator passageway due to abrupt changes in the air flow through the vacuum passageway from the finger members to the vacuum source.

19. The vacuum flow sensor of claim 18 wherein the actuator passageway includes a first portion and a second portion, with the first portion of the actuator passageway comprising a hollow parallelepiped including a first closed end, a second open end, a first closed face, a second closed face, a first closed side, and a second closed side, with the second portion of the actuator passageway comprising a hollow parallelepiped including a first closed end, a second open end, a first closed face, a second closed face, a first closed side, and a second closed side, with the second ends of the first and second portions of the actuator passageway being connected and with the first faces of the first and second portions intersecting at an angle in the range of 155° and with the second faces of the first and second portions intersecting at an angle in the range of 155°, with the actuator seating in the first end of the first portion of the actuator passageway in the first position, with the actuator ricocheting off the second face of the first portion of the actuator passageway moving to its first position under the force of gravity and with the second face of the second portion of the actuator passageway restraining the actuator in the first portion of the actuator passageway in the event of the abrupt stopping of air flow through the vacuum passageway from the finger members to the vacuum source and which could cause the actuator to rebound out of its first position.

20. In a printing press or the like where a sheet of paper is moved from one position to another by picking the sheet of paper up by vacuum finger members connected to a vacuum source through a vacuum passageway, with the printing press including suitable controls for operating the printing press, with the improvement comprising a vacuum flow sensor located in the vacuum passageway between the vacuum finger members and the vacuum source comprising, in combination: a body member having an actuator passageway, with the actuator passageway intersecting with and dividing the vacuum passageway into a first portion and a second portion; an actuator movable within the actuator passageway towards a first position when a sheet of paper has been picked up by the finger members and is blocking the finger members and blocking the flow of air through the finger members to the vacuum source through the vacuum passageway allowing the actuator to fall to its first position under the force of gravity and movable away from the first position under the force of air flowing through the finger members to the vacuum source through the vacuum passageway and against the force of gravity when a sheet of paper is not blocking the finger members; and wherein the actuator passageway includes a first portion and a second portion, with the first portion of the actuator passageway comprising a hollow parallelepiped including a first closed end, a second open end, a first closed face, a second closed face, a first closed side, and a second closed side, with the second portion of the actuator passageway comprising a hollow parallelepiped including a first closed end, a second open end, a first closed face, a second closed face, a first closed side, and a second closed side, with the second ends of the first and second portions of the actuator passageway being connected and with the first faces of the first and second portions intersecting at an angle in the range of 155° and with the second faces of the first and second portions intersecting at an angle in the range of 155°, with the actuator seating in the first end of the first portion of the actuator passageway in the first position, with the actuator ricocheting off the second face of the first portion of the actuator passageway moving to its first position under the force of gravity and with the second face of the second portion of the actuator passageway restraining the actuator in the first portion of the actuator passageway in the event of the abrupt stopping of air flow through the vacuum passageway from the finger members to the vacuum source and which could cause the actuator to rebound out of its first position.

* * * * *